US012110657B2

(12) United States Patent
Shin et al.

(10) Patent No.: US 12,110,657 B2
(45) Date of Patent: Oct. 8, 2024

(54) CONSTRUCTION EQUIPMENT

(71) Applicant: Volvo Construction Equipment AB, Eskilstuna (SE)

(72) Inventors: Heungju Shin, Gyeongsangnam-do (KR); Sanghee Lee, Gyeongsangnam-do (KR); Dongsoo Kim, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 356 days.

(21) Appl. No.: 17/601,251

(22) PCT Filed: Apr. 5, 2019

(86) PCT No.: PCT/KR2019/004109
§ 371 (c)(1),
(2) Date: Oct. 4, 2021

(87) PCT Pub. No.: WO2020/204239
PCT Pub. Date: Oct. 8, 2020

(65) Prior Publication Data

US 2022/0170236 A1 Jun. 2, 2022

(51) Int. Cl.
*E02F 9/00* (2006.01)
*E02F 3/43* (2006.01)
(Continued)

(52) U.S. Cl.
CPC ..... *E02F 9/123* (2013.01); *E02F 3/435* (2013.01); *E02F 9/265* (2013.01)

(58) Field of Classification Search
CPC ..... E02F 9/123; E02F 3/435; E02F 9/265
(Continued)

(56) References Cited

U.S. PATENT DOCUMENTS

2019/0093321 A1 3/2019 Hiekata
2019/0284782 A1 9/2019 Izumikawa
2021/0009116 A1* 1/2021 Fujiyoshi ..... E02F 9/262

FOREIGN PATENT DOCUMENTS

EP 0416180 A1 3/1991
JP H03221628 A 9/1991
(Continued)

OTHER PUBLICATIONS

International Search Report and Written Opinion of the International Searching Authority, PCT/KR2019/004109, mailed Jan. 3, 2020, 9 pages (including English International Search Report).
(Continued)

*Primary Examiner* — Tiffany P Young
(74) *Attorney, Agent, or Firm* — Sage Patent Group

(57) ABSTRACT

Provided is construction equipment including: a lower traveling body; an upper rotating body rotatably supported on the lower traveling body; booms operated by respective cylinders; a work machine which includes an arm and an attachment and is supported by the upper rotating body; a rotating device which includes a swing motor for rotating the upper rotating body and a swing reduction gear for decelerating the rotation of the swing motor; a controller for outputting a control signal to the rotating device; and a swing control unit which receives an input for swing control of the upper rotating body, wherein the rotation of the upper rotating body can be automatically controlled through the swing control unit.

7 Claims, 5 Drawing Sheets

(51) Int. Cl.
*E02F 9/12* (2006.01)
*E02F 9/26* (2006.01)

(58) Field of Classification Search
USPC ..... 701/50
See application file for complete search history.

(56) References Cited

FOREIGN PATENT DOCUMENTS

| | | | | |
|---|---|---|---|---|
| JP | H0826676 | A | 1/1996 | |
| JP | 2017-157016 | A | 9/2017 | |
| JP | 2018159194 | A | 10/2018 | |
| JP | H0565725 | A | 3/2020 | |
| KR | 1020140009148 | | 1/2014 | |
| SU | 876886 | A1 | 10/1981 | |
| WO | 2020050997 | A1 | 5/2018 | |
| WO | WO-2018085553 | A1 * | 5/2018 | ..... E02F 3/435 |
| WO | WO-2018105527 | A1 * | 6/2018 | ..... E02F 9/2004 |

OTHER PUBLICATIONS

Extended European Search Report, European Application No. 19923408.9, mailed Oct. 28, 2022, 6 pages.
Chinese Office Action, Chinese Application No. 201980095107.X, mailed Oct. 26, 2022, 7 pages.
Notification of Decision for Patent Registration for Korean Patent Application No. 10-2021-7031701, including English summary, dated May 30, 2024, 8 pages.

* cited by examiner

CONSTRUCTION EQUIPMENT

CROSS REFERENCE TO RELATED APPLICATIONS

This application is a 35 U.S.C. § 371 national stage application of PCT International Application No. PCT/KR2019/004109 filed on Apr. 5, 2019, the disclosure and content of which is incorporated by reference herein in its entirety.

TECHNICAL FIELD

The present invention relates to a construction equipment. More specifically, the present invention relates to a construction equipment allowing a construction equipment operator to control the rotation radius of an upper rotating body according to construction sites and work environments.

BACKGROUND

An excavator is a construction equipment performing various tasks such as digging for digging up the ground at construction sites, etc., loading for carrying soil, excavating for making a foundation, crushing for dismantling buildings, grading for cleaning the ground, and leveling for leveling the ground, and have a lower traveling body for moving the equipment, an upper rotating body rotatably mounted on the lower traveling body, and a work machine, as its basic structure.

A construction equipment such as an excavator is used at various construction sites, and thus even operator's slight carelessness might lead to a very serious accident. Accordingly, recently, techniques of recognizing workers or obstacles near the construction equipment and sending an alarm to the operator or stopping the work machine are under development.

As a prior art document, Korean Patent Laid-open No. 10-2014-0009148 discloses a technique relating to a device for monitoring the periphery of a construction equipment allowing an operator to immediately recognize the location of the most dangerous obstacle with respect to the construction equipment by using a method of measuring a boom, an arm and a bucket, and the swing angle thereof and calculating an area that an excavator might reach, i.e., an area in which an excavator might hit the obstacle.

According to the aforementioned prior art, however, a separate sensor for measuring the angle and swing angle of the work machine is necessary. Further, in case an operator is not careful, he cannot prevent over-rotation of the upper rotating body which is more than necessary. Thus, there is a limit in preventing a collision caused by rotation of the construction equipment, and also, it is impossible to control the construction equipment to stop rotating repetitively and accurately, which is required at construction sites.

In addition, even if an experienced operator drives or the operator drives by calculating an area in which the construction equipment might collide with an obstacle according to the prior art, in the case of exchanging an attachment with another having a different shape or structure, the operator has a practical difficulty in precisely recognizing the difference in shape or structure of the exchanged attachment.

SUMMARY

The present invention is to solve the aforementioned problems of the prior art. It is an object of the present invention to provide a construction equipment capable of controlling the rotation of an upper rotating body in various ways by a construction equipment operator setting a swing pause point and a swing limit point.

An aspect of the present invention provides a construction equipment comprising a lower traveling body, an upper rotating body rotatably supported on the lower traveling body, a work machine supported on the upper rotating body, comprising a boom, an arm, and an attachment operated by respective cylinders, a rotating device comprising a swing motor for rotating the upper rotating body and a swing reduction gear for reducing rotation of the swing motor, a controller for outputting a control signal to the rotating device, and a swing control unit for receiving an input for swing control of the upper rotating body.

According to an embodiment, the swing control unit may further comprise a display unit for inputting swing control data on the upper rotating body and displaying the rotation state of the upper rotating body, and receive through the display unit an input for a swing stop point that is a position at which the upper rotating body stops rotating.

According to an embodiment, the swing stop point may comprise a swing pause point that is a position through which the upper rotating body passes by operator's operation after stopping rotation and/or a swing limit point that is a position through which the upper rotating body cannot pass after stopping rotation.

According to an embodiment, as to the swing pause point, whether to stop rotation of the upper rotating body may be input independently for the case where the upper rotating body passes through the swing pause point in the clockwise direction or for the case of passing through the swing pause point in the counterclockwise direction.

According to an embodiment, a plurality of the swing pause points or the swing limit points may be input.

According to an embodiment, when the rotation of the upper rotating body reaches a predetermined distance from the swing pause point or the swing limit point, the controller outputs a control signal to control the rotating device to reduce the rotation speed of the upper rotating body at a certain rate.

According to an embodiment, the construction equipment may further comprise an obstacle recognition sensor for detecting an obstacle within the rotation radius of the upper rotating body and transmitting a detection signal to the controller.

According to an embodiment, in the case of receiving a detection signal from the obstacle recognition sensor, the controller may be configured to control the rotating device to reduce the rotation speed of the upper rotating body to a predetermined speed or less.

According to an embodiment, the construction equipment may further comprise an attachment recognition sensor for recognizing data on an attachment of the work machine and transmitting the recognition information to the controller.

According to an embodiment, in the case of exchanging attachments of the work machine, the controller may be configured to receive information on the exchanged attachment of the work machine and calibrate the swing stop point.

According to an aspect of the present invention, a construction equipment operator may control the way and radius of rotation of an upper rotating body by setting a swing pause point and a swing limit point in different forms according to construction site environments or needs.

Accordingly, accidents such as collisions caused by over-rotation of the construction equipment may be prevented in advance, and rotation may be accurately controlled in works which require repetitive rotation of the construction equipment.

The effects of the present invention are not limited to the above-mentioned effects, and it should be understood that the effects of the present disclosure include all effects that could be inferred from the configuration of the invention described in the detailed description of the invention or the appended claims.

DETAILED DESCRIPTION

Hereinafter, examples of the present invention will be explained in detail with reference to the accompanying drawings.

Figure 1:
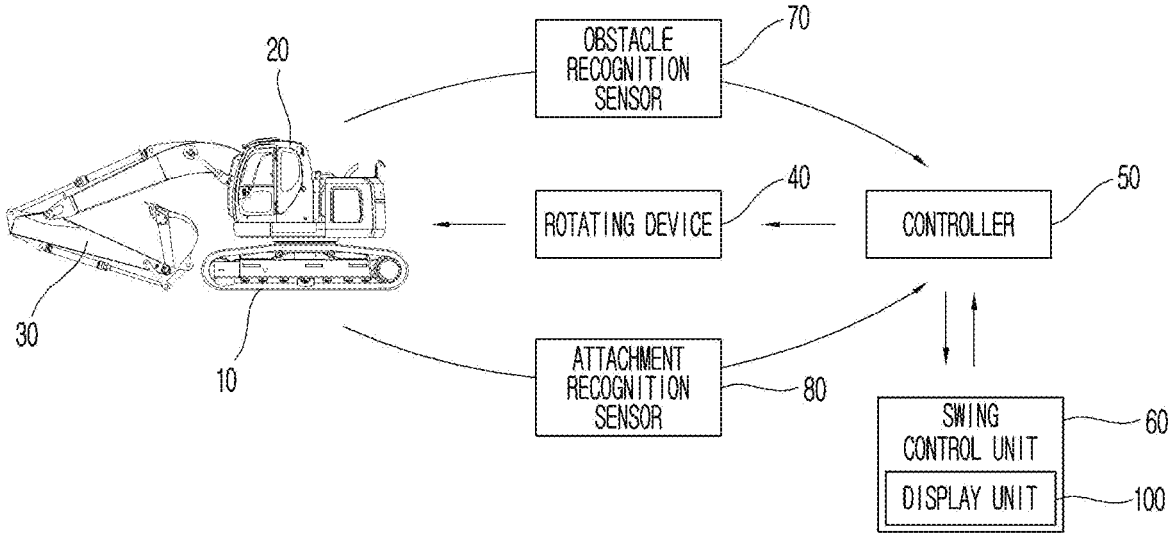
FIG. 1 is a schematic view of swing control according to an embodiment of the present invention.
Figure 2:
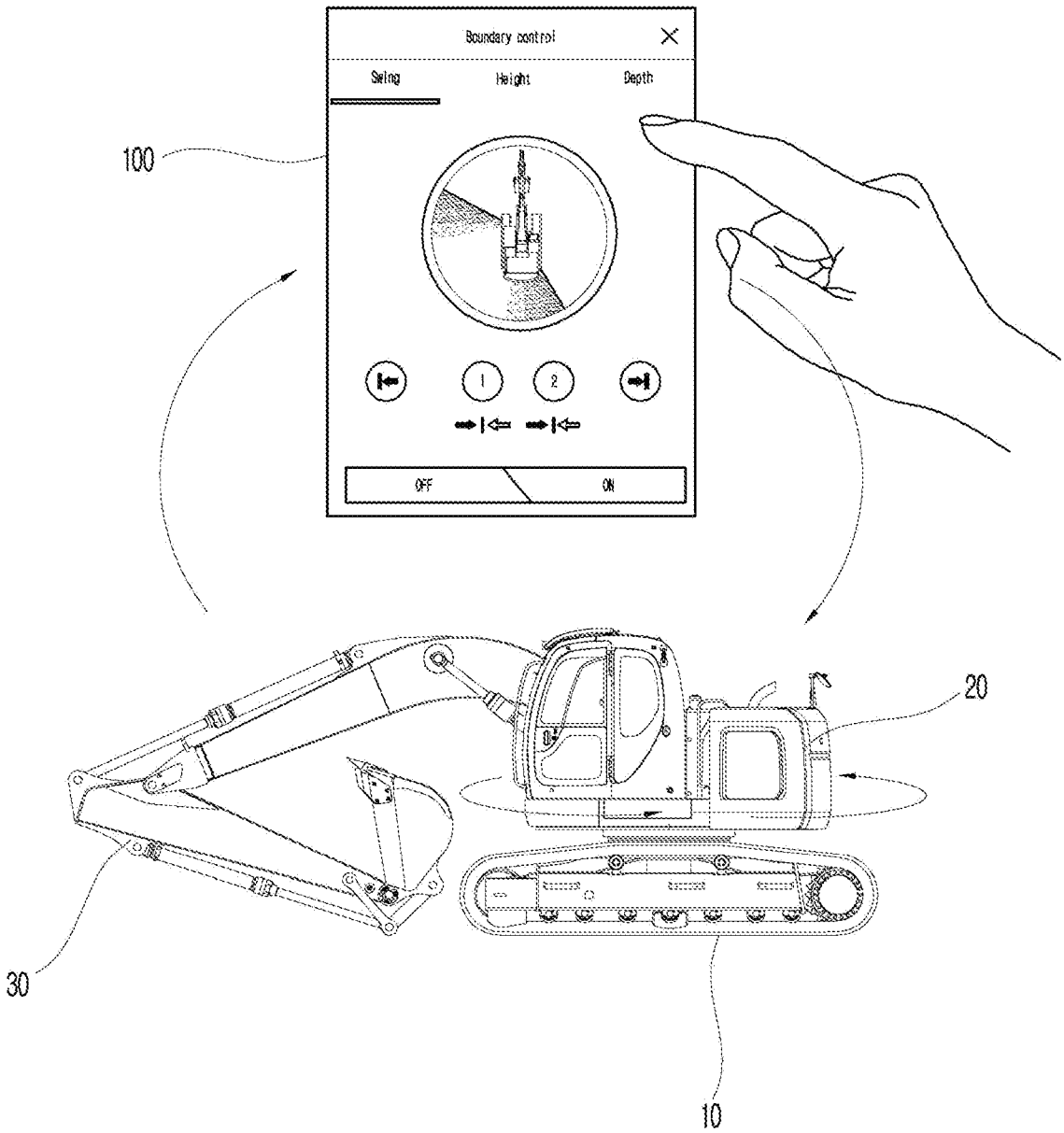
FIG. 2 is a schematic view of a construction equipment of which the rotation of an upper rotating body is controlled by an input on a display unit according to an embodiment of the present invention.
Figure 3:
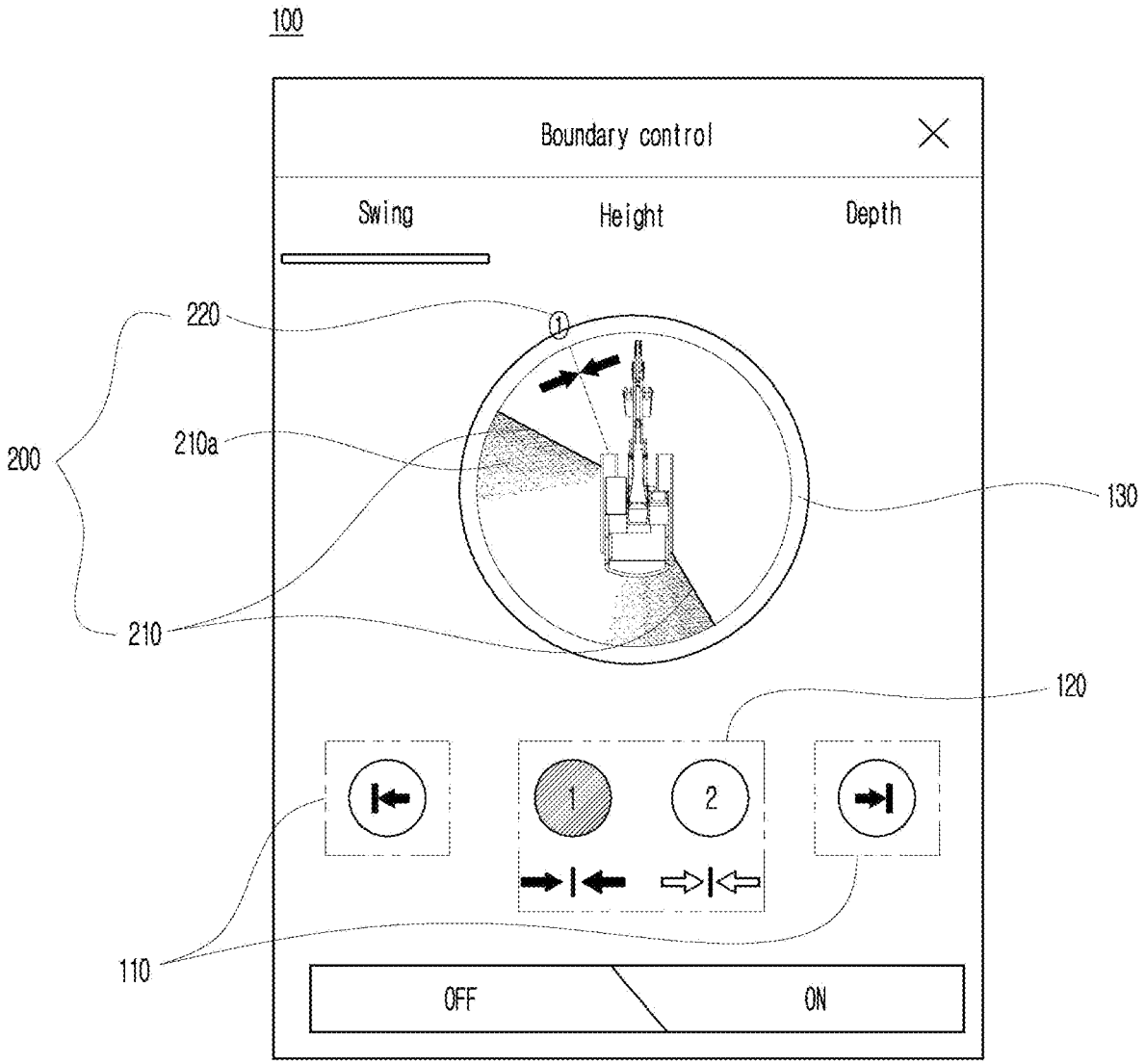
FIG. 3 is a schematic view of the display unit which illustrates an input of swing control according to an embodiment of the present invention.
Figure 4:
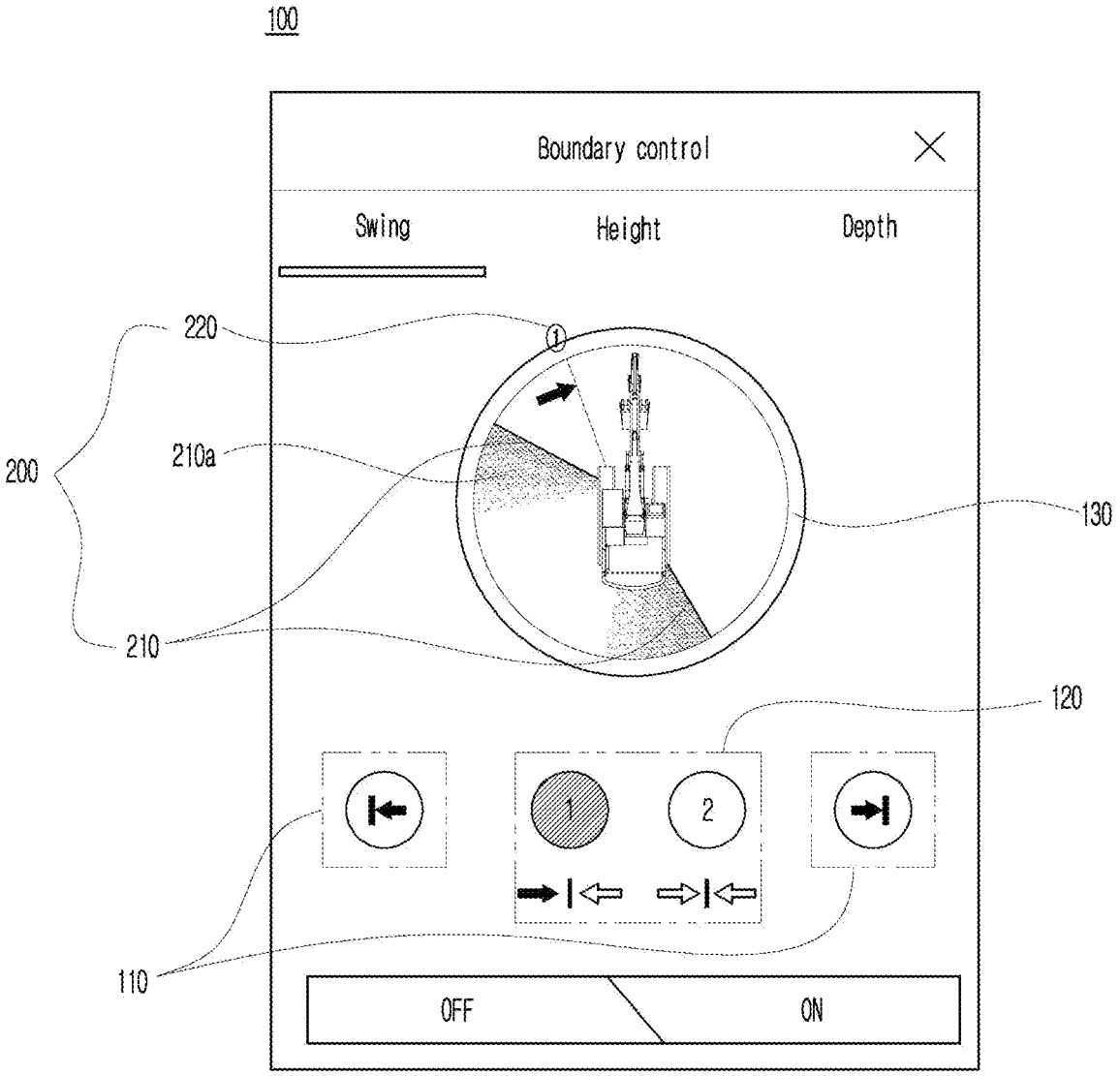
FIG. 4 is a schematic view of the display unit which illustrates an input of independently setting a swing pause point according to the rotation direction according to an embodiment of the present invention.
Figure 5:
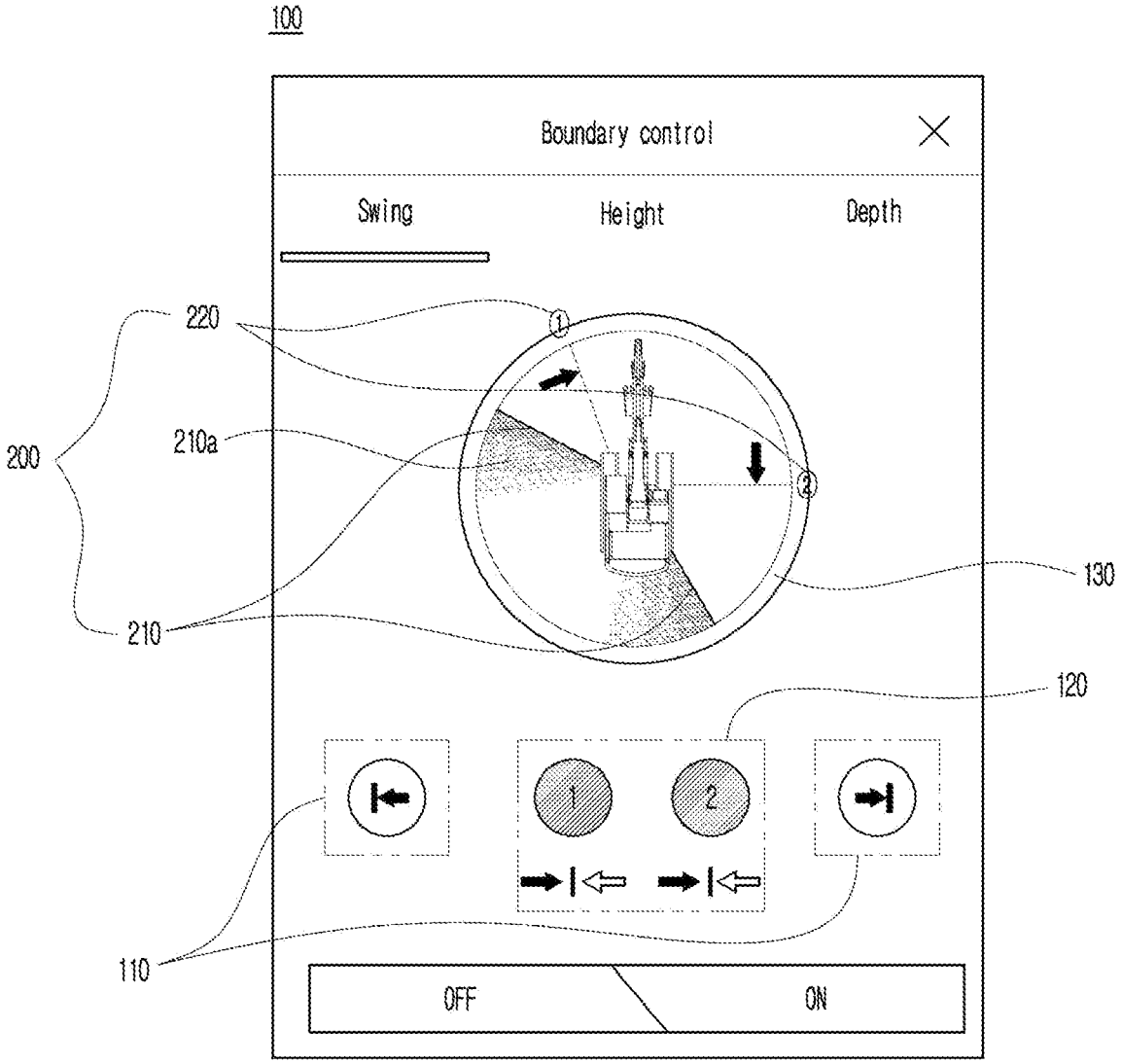
FIG. 5 is a schematic view of the display unit which illustrates an input of setting a plurality of swing pause points according to an embodiment of the present invention.

FIG. 1 is a schematic view illustrating a way to control swing of the present invention; FIG. 2 is a schematic view of a construction equipment of which the rotation is controlled by a data input on a display unit 100 of the present invention; and FIG. 3 to FIG. 5 are schematic views of the display unit 100 which illustrate ways to input swing stop points 200 according to various embodiments of the present invention, respectively.

The construction equipment of the present invention comprises a lower traveling body 10, an upper rotating body 20 rotatably supported on the lower traveling body 10, a work machine 30 supported on the upper rotating body 20, comprising a boom, an arm, and an attachment operated by respective cylinders, and a rotating device 40 comprising a swing motor for rotating the upper rotating body 20 and a swing reduction gear for reducing rotation of the swing motor.

The lower traveling body 10 supports the weights of the upper rotating body 20 and the work machine 30, and at the same time moves the construction equipment in forward and backward directions for the purpose of works.

The upper rotating body 20 is supported on the lower traveling body 10, and is designed to rotate on the lower traveling body 10 by the rotating device 40 comprising the swing motor, the swing reduction gear, etc.

To be more specific, the upper rotating body 20 is coupled to the lower traveling body 10 with a bearing on a frame of the lower traveling body 10. When power supplied from the swing motor is transferred to the swing reduction gear, the swing reduction gear rotates the upper rotating body 20 by being fixed with the lower traveling body 10 to revolve.

An operator's cab of the construction equipment may be provided in the upper rotating body 20, and an operator's seat may be prepared in the operator's cab for an operator to sit. In front of the operator's seat, a handle or pedal, etc. to work or operate the construction equipment may be prepared diversely, and also a swing operation lever is prepared for the operator to control the swing of the upper rotating body 20. The swing operation lever performs different control operations of the upper rotating body 20, such as for the upper rotating body 20 which stops rotating at a swing pause point 220 that will be described later to pass through the corresponding position and resume rotation, etc.

The work machine 30 is installed to be supported on the upper rotating body 20 to perform works of the construction equipment. Here, works may include various works in civil engineering works and construction sites. The work machine 30 may comprise a boom, an arm, and an attachment operated by respective cylinders, and is installed to be supported toward the front of the upper rotating body 20. As such, when the upper rotating body 20 rotates, the work machine 30 rotates along with the upper rotating body 20.

In case an operator is not careful enough during rotation of the upper rotating body 20 and the work machine 30 as above, an accident might occur which an attachment of the work machine 30 collides with nearby obstacles or workers, etc. Also, repetitive and accurate rotation is required for the attachment of the work machine 30 at certain intervals according to needs.

Hereinafter, a way to control swing of the present invention is explained in detail.

With reference to FIG. 1, the construction equipment of the present invention further comprises a controller 50 for outputting a control signal to the rotating device 40 and a swing control unit 60 for receiving an input for swing control of the upper rotating body 20.

An operator may set swing control of the construction equipment by inputting data on swing control of the upper rotating body 20 through the swing control unit 60. The swing control unit 60 transmits the input data on swing control to the controller 50. Then, the controller 50 outputs a control signal to the rotating device 40 to control the rotation of the upper rotating body 20.

The swing control unit 60 may comprise a display unit 100 allowing the operator to input data on swing control. The display unit 100 is used to allow the operator to input data through the screen, and also can provide the operator with information on the rotation state of the upper rotating body 20 and/or location of obstacles around the upper rotating body 20, etc.

With reference to FIGS. 3 to 5, various embodiments of swing control allowing an operator to input through the display unit 100 are explained.

An operator may designate through the display unit 100 a swing stop point 200 which is a position at which the rotation of the upper rotating body 20 stops. When the upper rotating body 20 reaches a specific position corresponding to the designated swing stop point 200, the controller 50 controls the rotating device 40 to reduce the rotation speed of the upper rotating body 20 to stop.

The swing stop point 200 may be divided into a swing limit point 210 and a swing pause point 220 based on whether it is possible to resume rotation by the operator's operation after the upper rotating body 20 stops rotating.

With reference to FIG. 3, the display unit 100 according to the present invention displays a swing state display unit 130, a swing limit operation unit 110, and a swing pause operation unit 120.

The swing state display unit 130 illustrates at the center the state of the construction equipment of the present invention seen from the top, to show the rotation state of the upper rotating body 20. That is, the degree to which the upper rotating body 20 rotates around the lower traveling body 10 is displayed, and an operator can easily find out the degree of rotation of the upper rotating body 20 and the position of the attachment of the work machine 30.

The swing state display unit 130 may be implemented selectively by displaying the rotation state of the lower traveling body 10 with respect to the upper rotating body 20 while the upper rotating body 20 is fixed in a certain direction or by displaying the rotation state of the upper rotating body 20 with respect to the lower traveling body 10 while the lower traveling body is fixed in a certain direction.

In addition, on the swing state display unit 130, the state in which data on swing control of the upper rotating body 20 is input, i.e., the swing pause point 220 and/or the swing limit point 210 designated according to the operator's input are/is displayed.

The operator may designate the swing pause point 220 through the swing pause operation unit 120 and the swing state display unit 130 on the display unit 100. To be specific, a construction equipment operator may designate the swing pause point 220 by selecting a position to be designated as the swing pause point 220 on the swing state display unit 130 after selecting the swing pause operation unit 120.

When the swing pause point 220 is set according to the aforementioned way, the controller 50 receives input information from the swing control unit 60 and outputs a control signal to the rotating device 40 so that the upper rotating body 20 stops rotating at a position corresponding to the swing pause point 220. After the rotation of the upper rotating body 20 stops at the designated swing pause point 220, when the operator operates the operation lever, the stopped upper rotating body 20 may resume rotation and pass through the position designated as the swing pause point 220.

In other words, when the swing pause point 220 is set according to swing control of the present invention, the rotation of the upper rotating body 20 stops at the position designated as the swing pause point 220 despite the operator's lever operation to swing continuously. After stopping, when the operator operates the operation lever, the controller 50 outputs a control signal to the rotating device 40 so that the upper rotating body 20 passes through the position designated as the swing pause point 220 to rotate.

The operator may designate the swing limit point 210 through the swing limit operation unit 110 and the swing state display unit 130 on the display unit 100.

To be specific, the operator may select two swing limit points 210 by selecting one button (left/right arrow) of the swing limit operation unit 110 and then selecting a position to be designated as the swing limit point 210 on the swing state display unit 130, and also selecting the other button (right/left arrow) of the swing limit operation unit 110 and then selecting a point other than the already selected swing limit point 210.

In this case, when it is assumed that the left/right buttons of the swing limit operation unit 110 are left arrow and right arrow, respectively, the area where the two arrow directions overlap is designated as the swing limit area 210*a*.

When the swing limit point 210 is designated as above, the controller 50 receives the input information from the swing control unit 60 and outputs a control signal to the rotating device 40 so that the upper rotating body 20 stops rotating at the position corresponding to the swing limit point 210. At this time, the controller 50 outputs a control signal to the rotating device 40 so that the upper rotating body 20 cannot pass through the position designated as the swing limit point 210, regardless of whether the operator operates the swing operation lever in the operator's cab.

In other words, when the swing limit point 210 is set according to the present invention, the rotation of the upper rotating body 20 stops at the position of the swing limit point 210, and the swing limit area 210*a* is formed in which the upper rotating body 20 cannot pass through the position designated as the swing limit point 210 even by the operator's operation of the swing operation lever.

With reference to FIG. 3, the shaded portion between the swing limit points 210 displayed on the swing state display unit 130 indicates the swing limit area 210*a* which the upper rotating body 20 cannot reach.

As such, the operator may designate the swing pause point 220 at a point where a momentary pause of the upper rotating body 20 is required and designate the swing limit points 210 at points where the rotation of the upper rotating body 20 is to be completely limited, thereby setting the swing limit area 210*a*, in consideration of construction sites to which the construction equipment of the present invention is applied and necessary works.

As to the swing pause point 220 according to another embodiment of the present invention, whether to stop rotation of the upper rotating body may be input independently for the case where the upper rotating body 20 passes through the swing pause point clockwise or for the case of passing through the swing pause point counterclockwise.

The upper rotating body 20 is rotatably supported on the lower traveling body 10 as described above, and the upper rotating body 20 may rotate clockwise or counterclockwise according to the operator's operation.

At this time, as to the swing pause point 220 of the present invention, the upper rotating body 20 may be set to stop rotating at the corresponding position regardless of the rotation direction of the upper rotating body 20, and also whether to stop rotation of the upper rotating body 20 may be set independently according to the rotation direction of the upper rotating body 20. That is, the upper rotating body 20 may be set to stop rotating only when the upper rotating body 20 rotates in a specific direction and reaches the swing pause point 220 and to keep rotating when the upper rotating body reaches the swing pause point 220 in the opposite direction.

With reference to FIG. 4, the swing pause operation unit 120 may be implemented to set the control according to the rotation direction of the upper rotating body 20 separately. That is, the swing pause operation unit 120 may be implemented to select the left arrow to stop rotation of the upper rotating body 20 in the counterclockwise direction and select the right arrow to stop rotation of the upper rotating body 20 in the clockwise direction.

At this time, the operator may set swing control according to the rotation direction by selecting the rotation direction of the upper rotating body 20 separately (selecting arrows below numbers) after selecting the swing pause operation unit 120 (selecting numbers), i.e., before inputting a position to be designated as the swing pause point 220 to the swing state display unit 130.

As illustrated in FIG. 4, the operator may designate whether to stop rotation of the upper rotating body 20 in the clockwise direction by selecting the right arrow after selecting the swing pause operation unit 120. Then, the operator may input a position to be designated as the swing pause point 220 to the swing state display unit 130 for the clockwise rotation of the upper rotating body 20.

When the swing pause point 220 is designated in the clockwise direction according to the aforementioned way, the controller 50 receives the designation information from the swing control unit 60 and outputs a control signal to the rotating device 40 to stop rotation at the position corresponding to the swing pause point 220 when the upper rotating body 20 rotates in the clockwise direction. On the other hand, the controller 50 outputs a control signal to the rotating device 40 to keep the upper rotating body 20 rotating without stopping at the position corresponding to the swing pause point 220 when the upper rotating body 20 rotates in the counterclockwise direction.

When the operator designates the left arrow the other way round, unlike FIG. 4, to select designation of counterclockwise direction of the upper rotating body 20, the controller 50 may control the upper rotating body 20 to stop rotating according to the opposite way.

Accordingly, the operator may set the swing pause point 220 to stop rotation of the upper rotating body 20 only in a specific direction according to needs in work sites to which the construction equipment of the present invention is applied.

A swing stop point 200 according to an embodiment of the present invention is characterized by setting a plurality of the swing pause points 220 or the swing limit points 210.

As illustrated in FIG. 5, the operator may need to set a plurality of the swing pause points 220 according to work environments. To this end, the swing pause operation unit 120 may be implemented to designate one or more swing pause points 220 separately. That is, the operator may select the number of swing pause points that he wants to designate in the swing pause operation unit 120 and then input positions to be designated as the swing pause points 220 to the swing state display unit 130.

Likewise, the operator may need to set a plurality of the swing limit points 210 according to work environments. To this end, the swing limit operation unit 110 may be implemented to designate one or more swing limit points 210 separately. That is, the operator may select the number of swing limit points that he wants to designate in the swing limit operation unit 110 and then input positions to be designated as the swing limit points 210 to the swing state display unit 130.

Aside from FIG. 5, of course, the present invention may be implemented to comprise three or more swing pause points 220 and swing limit points 210. As in the aforementioned one embodiment of the present invention, whether to stop rotation of the upper rotating body 20 at each of the plurality of swing pause points 220 may be set independently according to the rotation direction of the upper rotating body 20.

The controller 50 according to an embodiment of the present invention may control the rotating device 40 to reduce the rotation speed of the upper rotating body 20 at a certain rate when the rotation of the upper rotating body 20 reaches a predetermined distance from the swing pause point 220 or the swing limit point 210.

If the upper rotating body 20 suddenly reduces the rotation speed at the position corresponding to the swing pause point 220 or the swing limit point 210, it may adversely affect the performance and lifespan of the upper rotating body 20 and the rotating device 40, and the accurate rotation stop of the upper rotating body 20 cannot be guaranteed. Thus, the degradation in performance and the decrease in lifespan of the upper rotating body 20 and the rotating device 40 can be prevented by reducing the rotation speed of the upper rotating body 20 from a predetermined distance.

In addition, the construction equipment of the present invention may further comprise an obstacle recognition sensor 70 that can detect obstacles in the rotation environments of the upper rotating body 20. The obstacle recognition sensor 70 may be formed on the outer circumferential surface of the upper rotating body 20 or the lower traveling body 10 and include various types of sensor that can detect obstacles around the construction equipment.

When receiving a detection signal from the obstacle recognition sensor 70, the controller 50 controls the rotating device 40 to reduce the rotation speed of the upper rotating body 20 to a predetermined speed or less.

In addition, the display unit 100 may display on the swing state display unit 130 the existence of obstacles detected by the obstacle recognition sensor 70. Thus, the operator can easily find out the existence of obstacles within the rotation radius of the construction equipment and more efficiently prevent collisions caused by rotation of the upper rotating body 20.

Meanwhile, the work machine 30 of the present invention may be configured to have an attachment detachably installed at the end thereof. That is, the construction equipment to which the present invention is applied is configured to exchange attachments, and thus can be used for multiple purposes with multi-function.

In this regard, when the construction equipment exchanges an attachment with another having different shape and structure before exchange according to work purposes or work environments, if the same swing control regarding the rotation speed and rotation radius set for the attachment before exchange is applied, the rotation of the upper rotating body 20 may exhibit different rotation radius and rotation speed.

As such, when an attachment of the work machine 30 is exchanged, the operator needs to reset swing control regarding the rotation speed and rotation radius, etc. of the upper rotating body 20 on the basis of data information on the exchanged attachment.

Hereinafter, an embodiment of the present invention to solve the aforementioned problem is explained.

An embodiment of the present invention may further comprise an attachment recognition sensor 80 for recognizing data on an attachment mounted on the work machine 30 and transmitting the recognition information to the controller 50.

The attachment recognition sensor 80 detects the exchange of attachments of the work machine 30 and recognizes data information on the shape or structure, etc. of the exchanged attachment. For example, a wireless recognition sensor such as RFID, etc. may be used as the attachment recognition sensor 80. Further, the attachment recognition sensor 80 transmits the information on the exchanged attachment to the controller 50, and the controller 50 transmits the information to the swing control unit 60.

The swing control unit 60 may display on the display unit 100 an alarm requiring resetting swing control due to the exchange of attachments of the work machine 30. Thus, the construction equipment of the present invention prevents the swing control set for the attachment before exchange from applying to the attachment after exchange, and the operator may promptly reset swing control by reflecting the data on the exchanged attachment.

Meanwhile, when the attachment recognition sensor 80 detects the exchange of attachments, the controller 50 of the present invention is characterized by outputting a control signal to control the rotating device 40 to calibrate the rotation of the upper rotating body 20 by reflecting data on the shape, structure, weight, etc. of the exchanged attachment.

That is, the controller 50 may output a control signal to control the rotating device 40 to calibrate the rotation speed of the upper rotating body 20 according to the weight or size of the exchanged attachment on the basis of the data information on the exchanged attachment.

In addition, the controller 50 may output a control signal to control the upper rotating body 20 to calibrate the swing stop point 200 on the basis of the data information on the exchanged attachment. That is, the controller may control the rotating device 40 to stop rotation of the upper rotating body 20 at the same position as before exchange.

The foregoing description of the present invention has been presented for illustrative purposes, and it is apparent to a person having ordinary skill in the art that the present invention can be easily modified into other detailed forms without changing the technical idea or essential features of the present invention. Therefore, it should be understood that the forgoing embodiments are by way of example only, and are not intended to limit the present disclosure. For example, each component which has been described as a unitary part can be implemented as distributed parts. Likewise, each component which has been described as distributed parts can also be implemented as a combined part.

The scope of the present invention is presented by the accompanying claims, and it should be understood that all changes or modifications derived from the definitions and scopes of the claims and their equivalents fall within the scope of the present invention.

DESCRIPTION OF REFERENCE NUMERALS

10: lower traveling body
20: upper rotating body
30: work machine
40: rotating device
50: controller
60: swing control unit
70: obstacle recognition sensor
80: attachment recognition sensor
100: display unit
110: swing limit operation unit
120: swing pause operation unit
130: swing state display unit
200: swing stop point
210: swing limit point
210*a*: swing limit area
220: swing pause point

What is claimed is:

1. A construction equipment comprising:

a lower traveling body;

an upper rotating body rotatably supported on the lower traveling body;

a work machine supported on the upper rotating body, comprising a boom, an arm, and an attachment operated by respective cylinders;

a rotating device comprising a swing motor for rotating the upper rotating body and a swing reduction gear for reducing rotation of the swing motor;

a controller for outputting a control signal to the rotating device;

a swing control device for receiving an input for swing control of the upper rotating body, wherein the swing control device further comprises a display for inputting swing control data on the upper rotating body and displaying the rotation state of the upper rotating body, and receives through the display an input for a swing stop point that is a position at which the upper rotating body stops rotating, wherein the swing stop point is displayed on the display, wherein the swing stop point comprises a swing pause point that is a position through which the upper rotating body passes by operator's operation after stopping rotation and a swing limit point that is a position through which the upper rotating body cannot pass after stopping rotation, and wherein as to the swing pause point, whether to stop rotation of the upper rotating body is input independently for the case where the upper rotating body passes through the swing pause point in the clockwise direction or the case of passing through the swing pause point in the counterclockwise direction.

2. The construction equipment of claim 1, wherein a plurality of the swing pause points or the swing limit points may be input.

3. The construction equipment of claim 1, wherein when the rotation of the upper rotating body reaches a predetermined distance from the swing pause point or the swing limit point, the controller outputs a control signal to control the rotating device to reduce the rotation speed of the upper rotating body at a certain rate.

4. The construction equipment of claim 1, further comprising an obstacle recognition sensor for detecting an obstacle within the rotation radius of the upper rotating body and transmitting a detection signal to the controller.

5. The construction equipment of claim 4, wherein in the case of receiving a detection signal from the obstacle recognition sensor, the controller is configured to control the rotating device to reduce the rotation speed of the upper rotating body to a predetermined speed or less.

6. The construction equipment of claim 1, further comprising an attachment recognition sensor for recognizing data on an attachment of the work machine and transmitting the recognition information to the controller.

7. The construction equipment of claim 6, wherein in the case of exchanging attachments of the work machine, the controller is configured to receive information on the exchanged attachment of the work machine and calibrate the swing stop point.

* * * * *